US008728274B2

(12) United States Patent
Greschik et al.

(10) Patent No.: US 8,728,274 B2
(45) Date of Patent: May 20, 2014

(54) TREATMENT OF PULP

(75) Inventors: Thomas Christopher Greschik, Göteborg (SE); Hans Johansson-Vestin, Kungälv (SE); Håkan Fägersten, Kode (SE)

(73) Assignee: Akzo Nobel N.V., Arnhem (NL)

( * ) Notice: Subject to any disclaimer, the term of this patent is extended or adjusted under 35 U.S.C. 154(b) by 758 days.

(21) Appl. No.: 11/847,374

(22) Filed: Aug. 30, 2007

(65) Prior Publication Data

US 2008/0073043 A1 Mar. 27, 2008

Related U.S. Application Data

(60) Provisional application No. 60/846,485, filed on Sep. 22, 2006.

(51) Int. Cl.
*D21F 11/00* (2006.01)

(52) U.S. Cl.
USPC ..... 162/158; 162/181.1; 162/181.4

(58) Field of Classification Search
USPC ..... 162/168, 158, 181.1, 181.4
See application file for complete search history.

(56) References Cited

U.S. PATENT DOCUMENTS

| | | | | |
|---|---|---|---|---|
| 2,822,236 | A * | 2/1958 | Sheldon et al. | 162/160 |
| 4,388,150 | A | 6/1983 | Sunden et al. | |
| 4,537,655 | A | 8/1985 | Henriksson et al. | |
| 4,927,498 | A * | 5/1990 | Rushmere | 162/168.3 |
| 4,954,220 | A | 9/1990 | Rushmere | |
| 4,961,825 | A | 10/1990 | Andersson et al. | |
| 4,964,954 | A | 10/1990 | Johansson | |
| 4,980,025 | A | 12/1990 | Andersson et al. | |
| 5,035,772 | A | 7/1991 | Agnemo et al. | |
| 5,127,994 | A | 7/1992 | Johansson | |
| 5,167,766 | A | 12/1992 | Honig et al. | |
| 5,176,891 | A | 1/1993 | Rushmere | |
| 5,368,833 | A | 11/1994 | Johansson et al. | |
| 5,447,604 | A | 9/1995 | Johansson et al. | |
| 5,470,435 | A | 11/1995 | Rushmere et al. | |
| 5,543,014 | A | 8/1996 | Rushmere et al. | |
| 5,571,494 | A | 11/1996 | Saastamoinen | |
| 5,573,674 | A | 11/1996 | Lind et al. | |
| 5,584,966 | A | 12/1996 | Moffett | |
| 5,603,805 | A | 2/1997 | Andersson et al. | |
| 5,688,482 | A | 11/1997 | Saastamoinen | |
| 5,695,609 | A | 12/1997 | Petander et al. | |

(Continued)

FOREIGN PATENT DOCUMENTS

| | | |
|---|---|---|
| CA | 1288906 | 9/1991 |
| EP | 0 060 104 A1 | 9/1982 |

(Continued)

OTHER PUBLICATIONS

Smook, Handbook for Pulp and Paper Technologists, 1992, Angus Wilde Publications, 2nd edition.*

(Continued)

*Primary Examiner* — Anthony Calandra
(74) *Attorney, Agent, or Firm* — Robert C. Morriss

(57) ABSTRACT

The present invention relates to a method of treating an aqueous suspension of bleached pulp derived from an alkaline pulping process comprising dewatering and drying said suspension, wherein the pH of the suspension to be treated ranges from about 6.5 to about 12.

18 Claims, 1 Drawing Sheet

(56) References Cited

U.S. PATENT DOCUMENTS

| | | | | |
|---|---|---|---|---|
| 5,707,493 | A | 1/1998 | Saastamoinen | |
| 5,785,810 | A | 7/1998 | Salminen | |
| 5,788,815 | A * | 8/1998 | Norell et al. | 162/190 |
| 6,077,394 | A | 6/2000 | Spence et al. | |
| 6,918,992 | B1 * | 7/2005 | Strandberg et al. | 162/100 |
| 7,081,184 | B2 | 7/2006 | Wester et al. | |
| 2002/0096289 | A1 * | 7/2002 | Frolich et al. | 162/168.1 |
| 2007/0068640 | A1 * | 3/2007 | Pfalzer et al. | 162/9 |

FOREIGN PATENT DOCUMENTS

| | | | |
|---|---|---|---|
| EP | 1 584 743 | A1 | 10/2005 |
| WO | WO 2005/042841 | A1 * | 5/2005 |
| WO | WO 2005/098127 | A1 | 10/2005 |

OTHER PUBLICATIONS

Kawamura, Relationship Between Cooking/Bleaching Conditions and Hexenuronic Acid Content in Kraft Pulp, 2003, TAPPI, 2003 Fall technical Conference, whole document.*

Calcium Chloride MSDS [downloaded online www.jtbaker.com], Sep. 2009 [downloaded on Mar. 8, 2010], section 9.*

Paper Performance [downloaded online www.mohawkpaper.com], Jun. 2008 [downloaded online Mar. 8, 2010], Mohawk Paper, whole document.*

Smook, Handbook for Pulp and Paper Technologists, 1992, Angus Wilde Publications, 2nd edition, chapter 9.*

Smook, Handbook for Pulp and Paper Technologists, 1992, Angus Wilde Publications, 2nd edition, chapter 4.*

Smook, Handbook for Pulp and Paper Technologists, 1992, Angus Wilde Publications, 2nd edition, chapters 9 and 15.*

Smook, Handbook for Pulp and Paper Technologists, 1992, Angus Wilde Publications, 2nd edition, chapters 11 and 16.*

Gullichsen editor, Chemical Pulping 6A, 1999, Fapet Oy,p. A635-p. A665.*

Seuss, How to Improve Brightess Stability of ECF bleached Softwood and Hardwood Kraft6 Pulp, 2004, APPITA Conference,p. 1-12.*

Written Opinion of the International Preliminary Examining Authority for PCT/SE2007/050588.

European Search Report for Application No. EP 06 12 1100 dated Mar. 14, 2007.

Sears, Jr., G. W., "Determination of Specific Surface Area of Colloidal Silica by Titration with Sodium Hydroxide," Analytical Chemistry, vol. 28, No. 12 (1956) pp. 1981-1983.

Iler, R. K. et al., "Degree of Hydration of Particles of Colloidal Silica in Aqueous Solution," J. Phys. Chem., vol. 60 (1956) pp. 955-957.

"The Bleaching of Pulp," Third Edition, Tappi Press, edited by Singh, R. P. (1979) 2 title pages, pp. 378-379 and 388-391.

Grandstrom, A. et al., "Variables affecting the thermal yellowing of TCF-bleached birch kraft pulps," Nordic Pulp and Paper Research Journal, vol. 16, No. 1, pp. 18-23, 2001.

International Standard ISO 302, "Pulps—Determination of Kappa number," First edition (1981) 6 pages.

Gullichsen, J. et al., "Chemical Pulping," Papermaking Science and Technology, Book 6A (2000) 2 title pages, pp. A667-A686.

International Standard ISO 5351/1, "Cellulose in dilute solutions—Determination of limiting viscosity Number—Part 1: Method . . . ", First edition (1981) 16 pages.

International Standard ISO 2470, "Paper, board and pulps—Measurement of diffuse blue reflectance factor (ISO brightness)," Third edition (1999) 14 pages.

SCAN-CM 11:95, Tillverkning av laboratorieark (optiska egenskaper), Scandinavian Pulp, Paper and Board Testing Committee (1995) 6 pages.

SCAN-CM 11:95, Preparation of laboratory sheets (optical properties), Scandinavian Pulp, Paper and Board Testing Committee (1995) 6 pages.

Suess, H. U. et al., "How to Improve Brightness Stability of ECF bleached Softwood and Hardwood Kraft Pulp," APPITA Conference, Cranberra (2004) pp. 1-12.

Suess, H. U. et al., "ECF Bleaching of Hardwood Pulp: How much effect can be achieved in the E stage?," ABTCP 38 Congreso Anual, Sao Paulo (2005) 13 pages.

Jiang, Z-H. et al., "Hexenuronic acid groups in pulping and bleaching," ABTCP 2002, Sao Paulo, 18 pages.

The Ljungberg Textbook—Pulp Technology; Karlstads Universitet (2004) title page and pp. 18-21.

International Search Report for International Application No. PCT/SE2007/050588 dated Apr. 12, 2007.

Written Opinion for International Application No. PCT/SE2007/050588, Jul. 1, 2009.

* cited by examiner

TREATMENT OF PULP

BACKGROUND OF THE INVENTION

In the art of bleaching, the target is to provide pulp with high and stable brightness levels. However, brightness reversion of pulp occurs to varying extent during storage and transportation to the paper mill depending on e.g. temperature, humidity, wood species, cooking conditions and bleaching sequence. Also, dewatering and drying conditions of pulp subsequent to the final bleaching stage are of importance for brightness stability to the bleached pulp. When market pulp is to be transported from its place of manufacture to a paper mill, it should of economical and quality reasons be substantially dry. It is known that the operation of pulp drying machines can affect the brightness to varying degrees depending on the stability of the pulp and the drying conditions. For example, if the pulp is dried at high temperature and then baled, thermal brightness reversion continues during storage due to the high temperature and the humidity existing within the bale.

"The Bleaching of Pulp", Third Edition, Tappi press, edited by Singh, R. P, p. 378, 388-390, 1979, discloses that yellowing of pulps is faster the higher the temperature and the higher the humidity. It is further disclosed that color reversion is higher the higher the pH of the water from which a pulp sheet is made. It is thus conventional in the art to carry out drying at fairly low pH no matter which bleaching sequence has been performed on the pulp to be dried.

In the paper "Variables affecting the thermal yellowing of TCF-bleached birch Kraft pulps", Granström, A, Nordic Pulp and Paper Research Journal Vol. 16, no. 1/2001, various variables such as hexenuronic acid content, dry content, temperature, time and pH influencing the process of brightness reversion are discussed. This article shows varying degrees of brightness reversion depending on these variables, inter alia at pH values ranging from 3 to 6. Hexenuronic acid groups as mentioned in Granström are formed e.g. during alkaline pulping when 4-O-methyl-D-glucuronic acid groups of xylan are converted. The presence of hexenuronic acid groups has previously been suspected to be at least partly responsible for brightness reversion of pulps. Attempts to remove hexenuronic acid groups have therefore been made, e.g. by means of acid hydrolysis prior to bleaching or by selecting a bleaching sequence degrading hexenuronic acid groups. All these attempts, however, lead to a more complicated pulp production system and in most cases these attempts are associated with additional investments.

The present invention provides a method for improving the brightness stability of bleached pulps which have been subjected to alkaline pulping, particularly those which contain a certain degree of hexenuronic acid groups.

THE INVENTION

Figure 1:
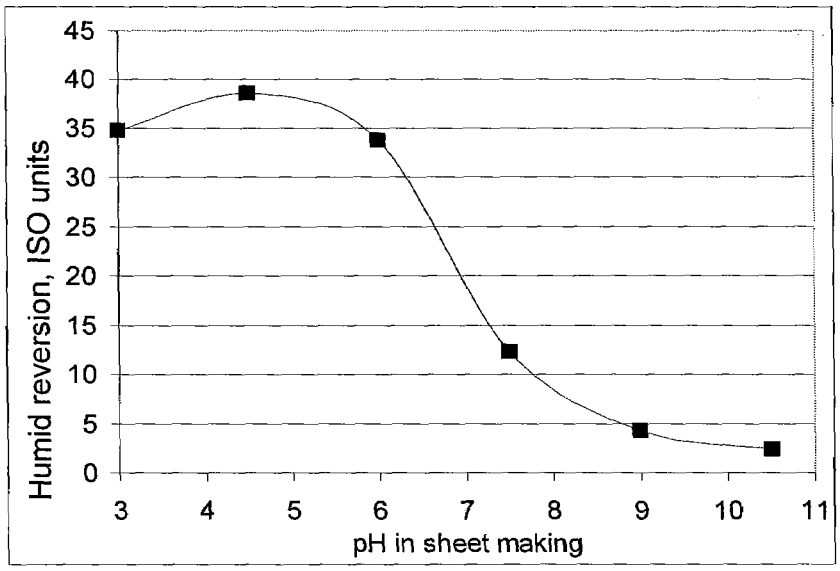
FIG. 1: Graph showing the effect of pH on Humid brightness reversion in sheet forming of bleached pulp.

The present invention relates to a method of treating an aqueous suspension of bleached pulp derived from an alkaline pulping process prior to papermaking, said method comprising dewatering and drying said suspension, wherein the pH of the suspension to be treated ranges from about 6.5 to about 12.

The pH of the pulp suspension may be monitored by use of any conventional technique, such as on-line sensors continuously measuring the pH. According to one embodiment, the pH ranges from about 7.5 to about 12 or from about 8.5 to about 12, e.g. from about 9 to about 11 or from about 9.5 to about 10.5. According to one embodiment, at least one pH-adjusting chemical is added to the bleached pulp before or during dewatering and/or drying to adjust the pH, for example in an amount from about 0.001 to about 50, from about 0.005 to about 20, or from about 0.01 to about 10 kg/ton dry pulp. The amounts of pH adjusting chemicals are given as amount of active substance. According to one embodiment, the pH is maintained within the claimed range throughout the method.

In the present application, the terms "dewatering" and "drying" should both be understood as signifying processes in which water is removed from the pulp. Both "dewatering" and "drying" thus involve "dewatering" but normally by use of different means or devices. Whereas dewatering normally involves pressing or draining water from the pulp suspension, drying involves elevating the temperature in relation to the temperature at which dewatering is performed.

The term "prior to papermaking" is intended to mean that the steps of the method are performed before the substantially dry pulp is supplied to a pulper where it is disintegrated in water and then supplied to the wet end of a paper machine.

The bleached pulp may be derived from lignocellulose-containing material which may comprise e.g. wood logs, finely-divided raw materials, and woody materials, such as wood particles and non-wood such as fibers of annual or perennial plants. The woody raw material can be derived from hardwood or softwood species such as birch, beech, aspen, alder, eucalyptus, maple, acacia, mixed tropical hardwood, pine, fir, hemlock, larch, spruce, and mixtures thereof. Non-wood plant raw material can be provided from e.g. straws of grain crops, reed canary grass, reeds, flax, hemp, kenaf, jute, ramie, sisal, abaca, coir, bamboo, bagasse or combinations thereof. However, also pulp derived from recycled pulp may be used, either separately or in mixtures with virgin pulps.

The pulp can be a chemical pulp produced by use of an alkaline pulping process. Examples of alkaline pulping processes are sulfate pulping, soda processes or modifications thereof with optional additives such as anthraquinone, e.g. soda anthraquinone (AQ) pulping process. The chemical pulp obtainable from lignocellulose-containing materials may be subjected to one or more oxygen treatment stages subsequent to the pulping process. The process can be applied e.g. to chemically digested pulps having an initial kappa number, i.e. the kappa number after digestion but before oxygen delignification, in the range from about 5 to about 60, for example from about 6 to about 50, or from about 8 to about 40, or from about 10 to about 30. The kappa number is measured according to the ISO 302 Standard Method.

The bleached pulp may have been obtained by any suitable bleaching sequences including Total Chlorine Free (TCF) bleaching sequences comprising e.g. ozone, peroxide, oxygen, peracids, alkaline extraction, acid hydrolysis, and chelating stages and combinations thereof; Elemental Chlorine Free (ECF) bleaching sequences including e.g. ozone, peroxide, oxygen, peracid, alkaline extraction, chlorine dioxide, and chelating stages and combinations thereof. The bleaching sequence, both ECF and TCF, can be finished with an acidic or an alkaline stage. According to one embodiment, the pulp may be solely bleached by use of alkaline bleaching stages, e.g. oxygen and/or peroxide bleaching stages resulting in a final pH from about 7.5 to about 12.

According to one embodiment, the final pH in the final bleaching stage ranges from about 1 to about 8, for example from about 2 to about 7 or from about 3 to about 6.

According to one embodiment, the hexenuronic acid content of the pulp before dewatering and drying ranges from about 1 to about 150, for example from about 5 to about 100, or from about 10 to about 90, or from about 30 to about 80, such as from about 50 to about 80 mmol/kg dry pulp. It has been found that the invention works particularly well for pulps having a hexenuronic acid content within the ranges as defined herein. Furthermore, it has been noticed that the present invention improves brightness stability of a pulp, making a preceding acid hydrolysis step prior to bleaching unnecessary.

The bleached pulp can be diluted before dewatering. According to one embodiment, the bleached pulp suspension has a dry content before dewatering ranging from about 0.1 to about 5, for example from about 0.5 to about 4, or from about 1 to about 3 wt %.

Dewatering and drying may be performed in various ways. According to one embodiment, the bleached pulp is cleaned, e.g. by means of a screen after the final bleaching stage before it is dried. In such a screen, remaining substances such as shives and bark may be removed. In the dewatering stage, a pulp can be subjected to different operations depending on how the pulp will be finally dried. For example, it can be dried as pulp sheets or flakes. For example, the bleached pulp suspension may be transferred to a headbox whereby a pulp web or pulp sheet is formed on a wire in a wet machine. The formed pulp sheet may have a grammage of 600-1000 g/m$^2$ and a dry content of from about 5 to about 50 wt %. A following dryer section may involve steam-heated dryer cylinders or an air flotation dryer. In an air flotation dryer, the pulp web may make several passes over rows of air bars. The pulp may be dried to a solid content of from about 90 to about 100 wt %. The dried pulp thus obtained may be cut into sheets and piled to make up bales of 200 to 300 kg.

According to one embodiment, the bleached pulp is compressed in e.g. a dewatering press to increase the dry content of the pulp resulting in a final dry content from about 20 to about 80, for example from about 30 to about 70 or from about 40 to about 60 wt %. The dewatering press generally presses the pulp against a screen which retains the pulp fibers but allows the water to be forced through the screen, optionally with the air of suction. For example, the dewatering press can be in the form of a pair of cylinders arranged to compress the pulp between them. Alternatively, the dewatering press can comprise a conveyor screw rotating within a screen. The pulp can then be formed into sheets or flakes which subsequently are dried.

The drying stage may also be performed in any other suitable dryer, e.g. a flash dryer known for drying pulp by hot gas, usually air, at a temperature of from about 200 to about 600° C. According to one embodiment, however, the drying is not performed by means of a flash dryer. The pulp, which may appear in particulate form, e.g. flakes, encounters in the flash dryer hot air, produced e.g. by burning oil or gas, and travels through ducting until it encounters the final cyclone. This separates hot moist air to give a final dryness of up to about 90 wt %. The pulp is subsequently transferred to a press in which pressed flakes can make up a bale. It is then treated like a bale of pulp sheets from a pulp dryer except that wrapping may be necessitated since such bales may disintegrate more readily during handling. Dewatering and drying operations are further well explained in e.g. "Papermaking Science and Technology", Gullichsen, J. et al, Book 6A, Chemical Pulping, p. A667-A686, 2000.

According to one embodiment, formed pulp sheets are subsequently formed into bales. The bales may have a dry content from about 50 to about 100 or from about 50 to about 98, for example from about 60 to about 95 or from about 70 to about 93 wt %.

According to one embodiment, at least one drainage chemical is added to the bleached pulp before and/or during dewatering, e.g. directly to the aqueous suspension of bleached pulp, for example in an amount from about 0.01 to about 10 or from about 0.05 to about 5 kg/ton dry pulp. It has been found that dewatering and/or drying of the bleached pulp in the presence of at least one drainage chemical can shorten the drying time considerably while the brightness stability is improved due to shorter exposure to elevated drying temperatures.

According to one embodiment, a combination of drainage chemicals are added to the bleached pulp suspension. According to one embodiment, a cationic polysaccharide can be used as drainage chemical selected from any polysaccharide known in the art including, for example, starches, guar gums, celluloses, chitins, chitosans, glycans, galactans, glucans, xanthan gums, pectins, mannans, dextrins, preferably starches and guar gums. Examples of suitable starches include potato, corn, wheat, tapioca, rice, waxy maize, barley etc. Suitably the cationic polysaccharide is water-dispersable or, preferably, water-soluble. Particularly suitable polysaccharides according to the invention include those comprising the general structural formula (I):

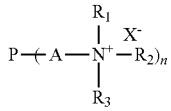

(I)

wherein P is a residue of a polysaccharide; A is a group attaching N to the polysaccharide residue, suitably a chain of atoms comprising C and H atoms, and optionally O and/or N atoms, usually an alkylene group with from 2 to 18 and suitably 2 to 8 carbon atoms, optionally interrupted or substituted by one or more heteroatoms, e.g. O or N, e.g. an alkyleneoxy group or hydroxy propylene group (—$CH_2$—CH(OH)—$CH_2$—); $R_1$, $R_2$, and $R_3$ are each H or, a hydrocarbon group, suitably alkyl, having from 1 to 3 carbon atoms, suitably 1 or 2 carbon atoms; n is an integer from about 2 to about 300,000, suitably from 5 to 200,000, for example from 6 to 125,000 or, alternatively, $R_1$, $R_2$ and $R_3$ together with N form an aromatic group containing from 5 to 12 carbon atoms; and $X^-$ is an anionic counterion, usually a halide like chloride.

Cationic polysaccharides according to the invention may also contain anionic groups, preferably in a minor amount. Such anionic groups may be introduced in the polysaccharide by means of chemical treatment or be present in the native polysaccharide.

The weight average molecular weight of the cationic polysaccharide can vary within wide limits depending on, inter alia, the type of polymer used, and usually it is at least about 5,000 and often at least 10,000. More often, it is above 150,000, normally above 500,000, suitably above about 700,000 or above about 1,000,000 or for example above about 2,000,000. The upper limit is not critical; it can be about 200,000,000, usually 150,000,000 and suitably 100,000,000.

The cationic polysaccharide can have a degree of cationic substitution ($DS_C$) varying over a wide range depending on, inter alia, the type of polymer used; $DS_C$ can be from 0.005 to 1.0, usually from 0.01 to 0.5, suitably from 0.02 to 0.3, or from 0.025 to 0.2.

According to one embodiment, the charge density of the cationic polysaccharide is within the range of from 0.05 to 6.0, suitably from 0.1 to 5.0 or from 0.2 to 4.0 meq/g of dry polymer.

According to one embodiment, an anionic polymer is added as drainage chemical which can be selected from inorganic and organic anionic polymers. Examples of suitable polymers include water-soluble and water-dispersible inorganic and organic anionic polymers.

Examples of suitable polymers include inorganic anionic polymers based on silicic acid and silicate, i.e., anionic silica-based polymers. Suitable anionic silica-based polymers can be prepared by condensation polymerisation of siliceous compounds, e.g. silicic acids and silicates, which can be homopolymerised or co-polymerised. According to one embodiment, the anionic silica-based polymers comprise anionic silica-based particles that are in the colloidal range of particle size. Anionic silica-based particles are usually supplied in the form of aqueous colloidal dispersions, so-called sols. The silica-based sols can be modified and contain other elements, e.g. aluminium, boron, nitrogen, zirconium, gallium and titanium, which can be present in the aqueous phase and/or in the silica-based particles. Examples of suitable anionic silica-based particles include polysilicic acids, polysilicic acid microgels, polysilicates, polysilicate microgels, colloidal silica, colloidal aluminium-modified silica, polyaluminosilicates, polyaluminosilicate microgels, polyborosilicates, etc. Examples of suitable anionic silica-based particles include those disclosed in U.S. Pat. Nos. 4,388,150; 4,927,498; 4,954,220; 4,961,825; 4,980,025; 5,127,994; 5,176,891; 5,368,833; 5,447,604; 5,470,435; 5,543,014; 5,571,494; 5,573,674; 5,584,966; 5,603,805; 5,688,482; and 5,707,493; which are hereby incorporated herein by reference.

Examples of suitable anionic silica-based particles include those having an average particle size below about 100 nm, for example below about 20 nm or in the range of from about 1 to about 10 nm. As conventional in the silica chemistry, the particle size refers to the average size of the primary particles, which may be aggregated or non-aggregated. According to one embodiment, the anionic silica-based polymer comprises aggregated anionic silica-based particles. The specific surface area of the silica-based particles is suitably at least 50 $m^2/g$, for example at least 100 $m^2/g$. Generally, the specific surface area can be up to about 1700 $m^2/g$, suitably up to about 1000 $m^2/g$. The specific surface area is measured by means of titration with NaOH as described by G. W. Sears in Analytical Chemistry 28(1956): 12, 1981-1983 and in U.S. Pat. No. 5,176,891 after appropriate removal of or adjustment for any compounds present in the sample that may disturb the titration like aluminium and boron species. The given area thus represents the average specific surface area of the particles.

In one embodiment of the invention, the anionic silica-based particles have a specific surface area within the range of from 50 to 1000 $m^2/g$, for example from 100 to 950 $m^2/g$. The silica-based particles may be present in a sol having a S-value in the range of from 8 to 50%, for example from 10 to 40%, containing silica-based particles with a specific surface area in the range of from 300 to 1000 $m^2/g$, suitably from 500 to 950 $m^2/g$, for example from 750 to 950 $m^2/g$, which sols can be modified as mentioned above. The S-value is measured and calculated as described by Iler & Dalton in J. Phys. Chem. 60(1956), 955-957. The S-value indicates the degree of aggregation or microgel formation and a lower S-value is indicative of a higher degree of aggregation.

In yet another embodiment of the invention, the silica-based particles have a high specific surface area, suitably above about 1000 $m^2/g$. The specific surface area can be in the range of from 1000 to 1700 $m^2/g$, for example from 1050 to 1600 $m^2/g$.

Further examples of suitable polymers include water-soluble and water-dispersible organic anionic polymers obtained by polymerizing an ethylenically unsaturated anionic or potentially anionic monomer or, a monomer mixture comprising one or more ethylenically unsaturated anionic or potentially anionic monomers, and optionally one or more other ethylenically unsaturated monomers. According to one embodiment, the ethylenically unsaturated monomers are water-soluble. Examples of suitable anionic and potentially anionic monomers include ethylenically unsaturated carboxylic acids and salts thereof, ethylenically unsaturated sulfonic acids and salts thereof, e.g. any one of those mentioned above. The monomer mixture can contain one or more water-soluble ethylenically unsaturated non-ionic monomers. Examples of suitable copolymerizable non-ionic monomers include acrylamide and the above-mentioned non-ionic acrylamide-based and acrylate-based monomers and vinylamines. The monomer mixture can also contain one or more water-soluble ethylenically unsaturated cationic and potentially cationic monomers, preferably in minor amounts. Examples of suitable copolymerizable cationic monomers include the monomers represented by the above general structural formula (I) and diallyldialkyl ammonium halides, e.g. diallyidimethyl ammonium chloride. The monomer mixture can also contain one or more polyfunctional crosslinking agents. The presence of a polyfunctional crosslinking agent in the monomer mixture renders possible preparation of polymers that are water-dispersible.

Examples of suitable polyfunctional crosslinking agents including the above-mentioned polyfunctional crosslinking agents. These agents can be used in the above-mentioned amounts. Examples of suitable water-dispersible organic anionic polymers include those disclosed in U.S. Pat. No. 5,167,766, which is incorporated herein by reference. Examples of copolymerizable monomers include (meth) acrylamide, and examples of preferred polymers include water-soluble and water-dispersible anionic acrylamide-based polymers.

According to one embodiment, an organic anionic polymer is used which is water-soluble, has a weight average molecular weight of at least about 500,000. Usually, the weight average molecular weight is at least about 1 million, suitably at least about 2 million or at least about 5 million. The upper limit is not critical; it can be about 50 million, usually 30 million.

According to one embodiment, an organic anionic polymer can have a charge density less than about 14, suitably less than about 10 meq/g, or less than about 4 meq/g. Suitably, the charge density is in the range of from 0.5 to 14.0, for example from 1.0 to 10.0 meq/g.

According to one embodiment, a cationic polymer is used as drainage chemical. The cationic polymer can have a charge density in the range of from 0.5 to 10.0, or from 1.0 to 8.5 meq/g. The cationic polymer can be selected from inorganic and organic cationic polymers and can be water-soluble. Examples of suitable cationic polymers include polyaluminium compounds, e.g. polyaluminium chlorides, polyaluminium sulfates, polyaluminium compounds containing both chloride and sulfate ions, polyaluminium silicate-sulfates, and mixtures thereof. Further examples of suitable cationic organic polymers include e.g. cationic acrylamide-based polymers; poly(diallyidialkyl ammonium halides), e.g. poly (diallyl-dimethyl ammonium chloride); polyethylene imines; polyamidoamines; polyamines; and vinylamine-based polymers. Examples of suitable cationic organic polymers include polymers prepared by polymerization of a water-soluble ethylenically unsaturated cationic monomer or, preferably, a monomer mixture comprising one or more water-soluble ethylenically unsaturated cationic monomers and optionally one or more other water-soluble ethylenically unsaturated monomers. Examples of suitable water-soluble ethylenically unsaturated cationic monomers include diallyldialkyl ammonium halides, e.g. diallyidimethyl ammonium chloride and cationic monomers represented by the general structural formula (II):

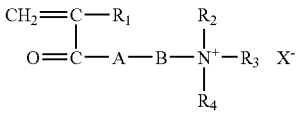

(II)

wherein $R_1$ is H or $CH_3$; $R_2$ and $R_3$ are each H or, a hydrocarbon group, suitably alkyl, having from 1 to 3 carbon atoms, for example 1 to 2 carbon atoms; A is O or NH; B is an alkyl or alkylene group having from 2 to 8 carbon atoms, suitably from 2 to 4 carbon atoms, or a hydroxy propylene group; $R_4$ is H or, a hydrocarbon group, suitably alkyl, having from 1 to 4 carbon atoms, preferably 1 to 2 carbon atoms, or a substituent containing an aromatic group, suitably a phenyl or substituted phenyl group, which can be attached to the nitrogen by means of an alkylene group usually having from 1 to 3 carbon atoms, suitably 1 to 2 carbon atoms, suitable $R_4$ including a benzyl group ($—CH_2—C_6H_5$); and X is an anionic counterion, usually a halide like chloride.

Examples of suitable monomers represented by the general structural formula (II) include quaternary monomers obtained by treating dialkylaminoalkyl(meth)acrylates, e.g. dimethylaminoethyl(meth)acrylate, diethylaminoethyl (meth)acrylate and dimethylamino-hydroxypropyl(meth) acrylate, and dialkylaminoalkyl(meth)acrylamides, e.g. dimethylamino-ethyl(meth)acrylamide, diethylaminoethyl (meth)acrylamide, dimethylaminopropyl(meth)acrylamide, and diethylaminopropyl(meth)acrylamide, with methyl chloride or benzyl chloride. Suitable cationic monomers of the general formula (II) include dimethylaminoethyl acrylate methyl chloride quaternary salt, dimethylaminoethyl methacrylate methyl chloride quaternary salt, dimethylaminoethyl acrylate benzyl chloride quaternary salt and dimethylaminoethyl methacrylate benzyl chloride quaternary salt.

The monomer mixture can contain one or more water-soluble ethylenically unsaturated non-ionic monomers. Examples of suitable copolymerizable non-ionic monomers include acrylamide and acrylamide-based monomers, e.g. methacrylamide, N-alkyl(meth)acrylamides, e.g. N-methyl (meth)acrylamide, N-ethyl(meth)acrylamide, N-n-propyl (meth)acrylamide, N-isopropyl(meth)acrylamide, N-n-butyl (meth)acrylamide, N-t-butyl(meth)acrylamide and N-isobutyl(meth)acrylamide; N-alkoxyalkyl(meth)acrylamides, e.g. N-n-butoxymethyl(meth)acrylamide, and N-isobutoxymethyl(meth)acrylamide; N,N-dialkyl(meth) acrylamides, e.g. N,N-dimethyl(meth)acrylamide; dialkylaminoalkyl(meth)acrylamides; -acrylate-based monomers like dialkylaminoalkyl(meth)acrylates; and vinylamines. The monomer mixture can also contain one or more water-soluble ethylenically unsaturated anionic or potentially anionic monomers, suitably in minor amounts. The term "potentially anionic monomer", as used herein, is meant to include a monomer bearing a potentially ionisable group which becomes anionic when included in a polymer on application to the cellulosic suspension. Examples of suitable copolymerizable anionic and potentially anionic monomers include ethylenically unsaturated carboxylic acids and salts thereof, e.g. (meth)acrylic acid and salts thereof, suitably sodium(meth) acrylate, ethylenically unsaturated sulfonic acids and salts thereof, e.g. 2-acrylamido-2-methylpropanesulfonate, sulfoethyl-(meth)acrylate, vinylsulfonic acid and salts thereof, styrenesulfonate, and paravinyl phenol(hydroxy styrene) and salts thereof. Examples of copolymerizable monomers include acrylamide and methacrylamide, i.e. (meth)acrylamide, and examples of preferred cationic organic polymers include cationic acrylamide-based polymer, i.e. a cationic polymer prepared from a monomer mixture comprising one or more of acrylamide and acrylamide-based monomers The cationic organic polymer can have a weight average molecular weight of at least 10,000, often at least 50,000. More often, it is at least 100,000 and usually at least about 500,000, suitably at least about 1 million or above about 2 million. The upper limit is not critical; it can be about 30 million, usually 20 million.

Examples of drainage aids systems include:

(i) cationic starch and anionic silica-based particles;
(ii) cationic starch and water-soluble or water-dispersible anionic acrylamide-based polymer;
(iii) cationic acrylamide-based polymer, cationic starch, and anionic silica-based particles;
(iv) cationic polyacrylamide-based polymer, and anionic silica based particles
(v) cationic polyaluminium compound, cationic starch, and anionic silica-based particles;
(vi) cationic acrylamide-based polymer, cationic starch, and water-soluble or water-dispersible anionic acrylamide-based polymer;

According to one embodiment, a) a cationic starch or a cationic polyacrylamide-based polymer, and b) anionic silica-based particles or an anionic water-soluble or water-dispersible polyacrylamide-based polymer, are added to the aqueous suspension.

According to one embodiment, sulfite is not added to the suspension.

The invention also relates to a pulp sheet obtainable from the method as disclosed herein. The pulp sheet may be used for production of any type of paper or board.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. The following examples will further illustrate how the described invention may be performed without limiting the scope of it.

All parts and percentages refer to part and percent by weight, if not otherwise stated.

EXAMPLES

The experiments according to examples 1-3 were conducted on oxygen predelignified eucalyptus pulp bleached in the sequence QPQP to a final brightness of 88% ISO. The Q stage is a chelating stage removing transition metals that could deteriorate the performance of the hydrogen peroxide used as a bleaching agent in the peroxide (P) stages. Kappa number, ISO brightness and hexenuronic content of the pulp before entering the bleaching sequence were 12.2, 51% ISO and 62.8 mmol/kg dry pulp respectively. The bleaching trials were performed in sealed polyethylene bags heated in a water-bath with the desired temperature preset.

The treatment conditions were:

Q: 60 minutes, final pH 5.4, EDTA 2 kg/ton dry pulp, pulp consistency 10%

P: 240 minutes, final pH 11.3, $H_2O_2$ 10 kg/ton dry pulp, pulp consistency 10%

Q: 30 minutes, final pH 6.7, EDTA 1 kg/ton dry pulp, pulp consistency 10%

P: 960 minutes, final pH 11.2, $H_2O_2$ 10 kg/ton dry pulp, pulp consistency 10%

The brightness, kappa number and content of hexenuronic acids (HexA) of the bleached pulp were 88.2% ISO, 7.3 and 54 mmol/kg respectively. After each stage washing was performed with deionised water, resulting in a washing efficiency of 96 wt %. The kappa number, viscosity and ISO brightness were determined according to ISO 302, ISO 5351 and ISO 2470 respectively. The HexA was determined by acidic hydrolysis of the pulp in a formate buffer followed by UV analysis of the 2-furoic acid formed in the hydrolysate. The residual levels of hydrogen peroxide were established by iodometric titration with sodium thiosulfate.

The humid brightness reversion of the pulp was evaluated under humid conditions by measuring the brightness loss after the pulp sheet had been conditioned at 23° C. and 50% relative humidity, sealed in a polyethylene bag and kept at 70° C. for 64 h, and finally removed from the bag and temperated at room temperature for at least 1 h before measuring the reverted brightness. The brightness reversion was expressed as the difference in brightness units between the non-aged and aged sheets.

The dewatering was determined by use of a Dynamic Drainage Analyser (DDA) available from Akribi, Sweden. For each trial 800 g pulp suspension at a pulp consistency of 1.5 wt % was transferred to the feed jar of the DDA. Then the experiments were conducted as described below:

| | Time, s |
|---|---|
| Stirring started at 1500 rpm | 0 |
| CPAM charge | 10 |
| Silica charge | 15 |
| Stirring stop, propeller up | 20 |
| Valve opened | 21 |

wherein CPAM is a cationic polyacrylamide and silica is an aluminium-modified silica sol. When the valve was opened vacuum was applied to obtain suction force. The time needed to unseal the water in the resultant pulp pad was monitored by vacuum measurement.

Example 1

In the experiments, sheets were formed from the bleached pulp following the standard ISO method, SCAN-CM 11:95, except that the pH was varied from pH 3 to pH 10.5. The standard method implies to perform sheet forming at pH 5±0.3 (SCAN-CM 11:95). To adjust the pH to the desired levels, $H_2SO_4$ or NaOH was used. As can be seen in Table 1 and FIG. 1, humid brightness reversion substantially decreased at an increased sheet forming pH above 6.5.

TABLE 1

| | Sheet forming pH | | | | | |
|---|---|---|---|---|---|---|
| | 3.0 | 4.5 | 6.0 | 7.5 | 9.0 | 10.5 |
| Brightness before ageing [% ISO] | 88.0 | 88.6 | 88.8 | 89.0 | 89.0 | 88.8 |
| Brightness after humid ageing [% ISO] | 53.2 | 50.0 | 55.0 | 76.7 | 84.7 | 86.4 |
| Brightness reversion [% ISO units] | 34.8 | 38.6 | 33.8 | 12.3 | 4.3 | 2.4 |

Example 2

Figure 2:
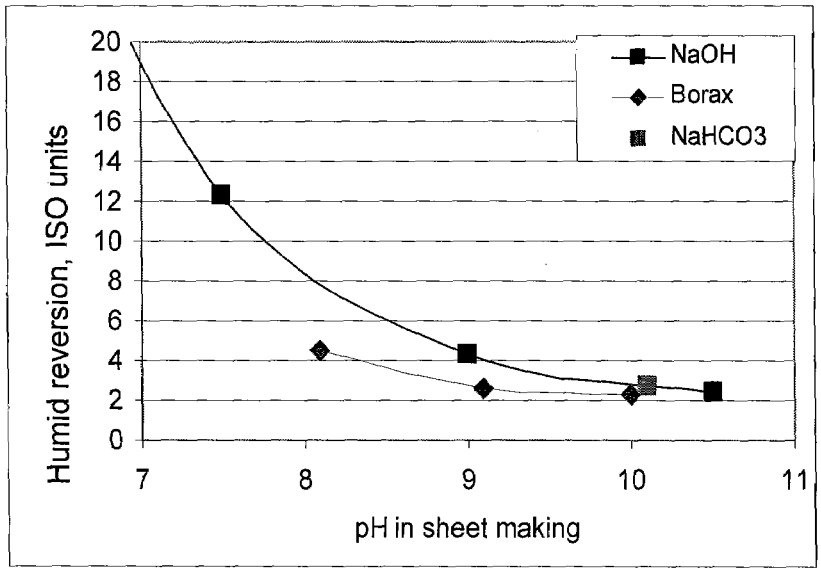
FIG. 2: Graph showing the effect of pH on Humid brightness reversion in sheet forming of bleached pulp.

It was also investigated how different approaches to obtain the sheet forming pH affected the humid brightness reversion. The sheets were prepared as in example 1, except that the pH in sheet forming was established using buffers instead of $H_2SO_4$ and NaOH. The buffers used were (Borax+NaOH) at pH 8.1, 9.1 and 10.0; and ($NaHCO_3$+NaOH) at pH 10. FIG. 2 shows that high sheet forming pH obtained by use of buffers also results in substantially decreased humid brightness reversion.

Example 3

The experiment was performed using the same bleached pulp as used in examples 1 and 2. The time for dewatering was increased by 20% when increasing the pulp suspension pH from pH 5 to pH 9. A combination of two dewatering agents, i.e. a CPAM (cationic polyacrylamide having a charge of 1.2 meq/g and a molecular weight of about 7,000,000 Dalton) and silica nanoparticles (colloidal aluminum-modified silica having a specific surface area of about 900 $m^2/g$ and an S-value of about 22%) were applied to the pulp suspension at pH 9. The charges were 0.5 kg/t pulp for each dewatering chemical. The time of dewatering was decreased by 20% compared to the reference suspension at pH 5. The results are elucidated in Table 2. Sheets were formed using the resultant pulp after dewatering. The pH was kept at pH 5 and pH 9 throughout the sheeting process. The sheets were subjected to the humid reversion test. The results in Table 2 shows that the time of dewatering is longer at a pH of 9 in the absence of dewatering agents compared to pH 9 in the presence of dewatering agents. Should the time of dewatering have been interrupted at 10 seconds, i.e. the dewatering time at pH 5, more water would have been maintained in the pulp after dewatering which in turn would necessitate prolonged drying time. It is known in the art that longer drying time and/or drying at an increased temperature level in order to obtain the same final dryness as at pH 5 would result in increased brightness reversion. Dewatering of the pulp by use of dewatering agents thus contributes to shortened drying time and, as a consequence, increased brightness stability.

TABLE 2

| | pH 5 | pH 9 | |
|---|---|---|---|
| Dewatering chemicals | No | No | Yes |
| Brightness reversion [% ISO units] | 38 | 6 | 5 |
| Dynamic drainage time [sec] | 10 | 12 | 8 |

Example 4

The following experiments were conducted on oxygen pre-delignified eucalyptus pulp bleached to a final brightness of 91% ISO by using the bleaching sequences Z D P, D EOP D P and D EOP D D. The Kappa number, ISO brightness, and hexenuronic content of the pulp before entering the bleaching sequences were 10.0, 53.6% ISO and 63 mmol/kg dry pulp respectively. The bleaching conditions are set out in tables 3-8 below.

TABLE 3 sequence Z D P

| Stage | Time [minutes] | Temperature [° C.] | Charge [kg/ton] | Pulp consistency [%] | pH (final) |
|---|---|---|---|---|---|
| Z | | | 4.7 | <30 | 2.9 |
| D | 65 | 80 | 25 | 10 | 3.0 |
| P | 111 | 88 | 8 | 10 | 10.5-11 |

TABLE 4 sequence D EOP D P

| Stage | Time [minutes] | Temperature [° C.] | Charge [kg/ton] | Pulp consistency [%] | Pressure [MPa] | pH (final) |
|---|---|---|---|---|---|---|
| D | 45 | 60 | 15 | 10 | — | 3 |
| EOP | 60 | 80 | 2 | 10 | 0.5 | 11.5 |
| D | 120 | 80 | 10 | 10 | — | 3 |
| P | 120 | 80 | 3 | 10 | — | 11.5 |

TABLE 5 sequence D EOP D D

| Stage | Time [minutes] | Temperature [° C.] | Charge [kg/ton] | Pulp consistency [%] | Oxygen [MPa] | pH (final) |
|---|---|---|---|---|---|---|
| D | 45 | 60 | 16 | 10 | — | 3 |
| EOP | 60 | 80 | 2 | 10 | 0.5 | 11.5 |
| D | 120 | 80 | 12 | 10 | — | 3 |
| D | 120 | 80 | 4 | 10 | — | 11.5 |

After each stage washing was performed with deionised water, resulting in a washing efficiency of 96%.

TABLE 6 hexenuronic acid content after bleaching

| Sequence | HexA mmol/kg |
|---|---|
| Z D P | 7.2 |
| D EOP D P | 12.5 |
| D EOP D D | 3.8 |

TABLE 7 humid brightness reversion [% ISO units]

| Sheet forming pH | ZDP | D EOP D P | D EOP D D |
|---|---|---|---|
| 5 | 10.5 | 11.4 | 10.9 |
| 7 | 7.2 | 5.3 | 8.5 |
| 9 | 1.7 | 3.1 | 8.1 |
| 11 | 1.8 | 2.9 | 6.1 |

From table 7 above, it can be seen that an improved humid brightness reversion is obtained for sheet forming pH according to the instant invention.

Example 5

An oxygen delignified softwood pulp with a kappa number of 10.2 and a brightness of 45% ISO was bleached in a D Q PO sequence. The bleaching conditions were in accordance with table 8.

TABLE 8

| Stage | Time [minutes] | Temperature [° C.] | Charge [kg/ton] | Oxygen [MPa] | Pulp consistency [%] | pH (final) |
|---|---|---|---|---|---|---|
| D | 40 | 60 | 20.4 | — | 12 | 2.9 |
| Q | 60 | 90 | 1 | — | 12 | 5.5 |
| PO | 120 | 100 | 17 | 0.5 | 12 | 11.5 |

The brightness after bleaching was 89.7% ISO and the kappa number was 1.7. Humid brightness reversion measurements were performed at pH 5 and 9 and the brightness reversions were 14 and 3.8% ISO units respectively.

The invention claimed is:

1. A method of treating an aqueous suspension of bleached pulp derived from an alkaline pulping process prior to papermaking, wherein the bleached pulp has a final pH in the range from about 7.5 to about 12, said method consisting of subjecting said bleached pulp to a dewatering step and dewatering said bleached pulp to a dry content of from about 20 to about 60 wt %, forming said dewatered pulp into a pulp web or pulp sheet, and drying said pulp web or pulp sheet to a dry content of from about 50 to about 100 wt % prior to papermaking, wherein the pH of the suspension during said dewatering and drying prior to papermaking is maintained in the range from about 7.5 to about 12, wherein the step of maintaining pH optionally includes adding at least one pH-adjusting chemical to the pulp before or during dewatering and/or drying, and wherein, optionally, at least one drainage chemical is added to the pulp before dewatering.

2. The method according to claim 1, wherein at least one drainage chemical is added to the pulp before dewatering.

3. The method according to claim 1, wherein the pH of the suspension ranges from about 9.5 to about 10.5.

4. The method according to claim 1, wherein at least one pH-adjusting chemical is added to the pulp before or during dewatering and/or drying.

5. The method according to claim 2, wherein at least one drainage chemical is added in an amount from about 0.01 to about 10 kg/ton dry pulp.

6. The method according to claim 1, wherein said at least one drainage chemical is a) a cationic starch or a cationic polyacrylamide-based polymer; and b) anionic silica-based particles or an anionic water-soluble or water-dispersible polyacrylamide-based polymer.

7. The method according to claim 1, wherein the bleached pulp has a hexenuronic acid content ranging from about 1 to about 100 mmol/kg dry pulp.

8. The method according to claim 1, wherein the pulp is a kraft pulp.

9. The method according to claim 1, wherein a pH-adjusting chemical is added in an amount from about 0.001 to about 50 kg/ton dry pulp.

10. The method according to claim 1, wherein the pH of the suspension ranges from about 8.5 to about 12.

11. The method according to claim 1, wherein the drying is not performed by means of a flash-dryer.

12. The method according to claim 1, wherein pulp sheets are formed during the dewatering stage.

13. The method according to claim 1, wherein the pH of the suspension ranges from 10.5 to 12.

14. The method according to claim 1, wherein the bleached pulp is dewatered to a dry content of from about 30 to about 60 wt %.

15. The method according to claim 14, wherein the pulp web or pulp sheet is dried to a dry content of from about 50 to about 98 wt %.

16. A method according to claim 7, wherein the bleached pulp has a hexenuronic acid content ranging from about 30 to about 80 mmol/kg dry pulp.

17. The method according to claim 14, wherein the bleached pulp is dewatered to a dry content of from about 40 to about 60 wt % and the pulp web or pulp sheet is dried to a dry content of from about 60 to about 95 wt %.

18. The method according to claim 17, wherein the pulp web or pulp sheet is dried to a dry content of from about 90 to about 95 wt %.

* * * * *